US007993174B2

(12) United States Patent
Hultsch et al.

(10) Patent No.: US 7,993,174 B2
(45) Date of Patent: Aug. 9, 2011

(54) TORQUE TRANSMISSION DEVICE FOR A SHIP

(75) Inventors: Hartmut Hultsch, Koenigsbrunn (DE); Ingo Sommer, Donauwoerth (DE)

(73) Assignee: Renk Aktiengesellschaft, Aügsburg (DE)

( * ) Notice: Subject to any disclaimer, the term of this patent is extended or adjusted under 35 U.S.C. 154(b) by 0 days.

(21) Appl. No.: 12/355,828

(22) Filed: Jan. 19, 2009

(65) Prior Publication Data

US 2009/0186537 A1 Jul. 23, 2009

(30) Foreign Application Priority Data

Jan. 21, 2008 (DE) ..... 10 2008 005 351

(51) Int. Cl.
*B63H 23/30* (2006.01)

(52) U.S. Cl. ..... 440/75; 384/455; 440/4

(58) Field of Classification Search ..... 440/3, 4, 440/75, 78, 83; 384/447, 455, 456, 563
See application file for complete search history.

(56) References Cited

U.S. PATENT DOCUMENTS 5,616,056 A * 4/1997 Meissner ..... 440/3
5,618,211 A * 4/1997 Bourgoin ..... 440/4
6,305,998 B1 * 10/2001 Schafer et al. ..... 440/75

FOREIGN PATENT DOCUMENTS

| | | |
|---|---|---|
| DE | 8 48 609 | 9/1952 |
| DE | 54 909 | 3/1967 |
| DE | 2 41 234 | 12/1986 |
| DE | 93 03 585 | 5/1993 |
| DE | 10 2005 050 021 | 4/2007 |
| EP | 19 58 868 | 8/2008 |
| JP | 55 0 87 697 | 7/1980 |
| JP | 2001 0 55 195 | 2/2001 |

* cited by examiner

*Primary Examiner* — Lars A Olson
(74) *Attorney, Agent, or Firm* — Cohen Pontani Lieberman & Pavane LLP

(57) ABSTRACT

A torque transmission device for a ship for optionally transmitting a drive torque from a main drive or from an auxiliary drive to a propeller shaft of the ship, with a gear unit which can be driven by the main drive and which can be connected to the propeller shaft by a first clutch, and with a second clutch by which the auxiliary drive can be connected to the propeller shaft. The gear unit is received in a gear unit housing, the first clutch and/or second clutch are/is received in a clutch housing that is separate from the gear unit housing, and the first clutch, the second clutch and/or the auxiliary drive are arranged on the side of the gear unit remote of a propeller.

20 Claims, 1 Drawing Sheet

TORQUE TRANSMISSION DEVICE FOR A SHIP

BACKGROUND OF THE INVENTION

1. Field of the Invention

The invention relates to a ship's torque transmission device for transmitting a drive torque from a main drive or from an auxiliary drive to a propeller shaft of the ship with a gear unit that can be driven by the main drive and which can be connected by a first clutch to the propeller shaft, and with a second clutch by which the auxiliary drive can be connected to the propeller shaft, and is further directed to a marine propulsion unit with a torque transmission device of this kind.

2. Description of the Prior Art

It is known to arrange clutches and gear units of the kind mentioned above in a common housing. However, in this solution the gear unit is disadvantageously burdened by dynamic influences of the clutches because of the common housing. Further, common housings of this kind are constructed so as to be correspondingly long and are therefore disadvantageous, for example, when assembling or sealing against oil.

In addition, when the clutches and/or auxiliary drive are arranged at the back side of the ship, i.e., on the side of the gear unit facing the propeller, the power train from the main drive, or from the gear unit which can be driven by this main drive, to the propeller of the ship is correspondingly lengthened.

SUMMARY OF THE INVENTION

It is an object of the present invention to improve a torque transmission device for a ship for optionally driving a propeller by means of a main drive or an auxiliary drive.

This object is met by a torque transmission device having the features of claim 1. Claim 14 claims protection for a marine propulsion unit with a torque transmission device of the kind mentioned above, and the subclaims are directed to advantageous further developments.

A torque transmission device for a ship according to one embodiment of the invention comprises a gear unit driven by one or more of a main drive, an auxiliary drive, and a propeller shaft for driving a propeller or screw.

The gear unit is preferably connected to the propeller shaft by a first clutch. This first clutch is constructed as an engaging and disengaging separating clutch, for example, as a multi-disk clutch or dry friction clutch, and permits the entire gear unit to be disengaged from the propeller shaft, which reduces power loss due to bearing friction and the like as well as noise. This is particularly advantageous at creep speed when the auxiliary drive is used exclusively. The first clutch can also be constructed itself as an engaging and disengaging synchronous clutch which automatically connects the gear unit to the propeller shaft when the gear unit output speed exceeds the propeller shaft speed.

The auxiliary drive is preferably connected to the propeller shaft by a second clutch. This second clutch can also be constructed in particular as an engaging and disengaging separating clutch, for example, as a multi-disk clutch or dry friction clutch, and permits the entire auxiliary drive to be disengaged from the propeller shaft, which reduces power loss due to bearing friction and the like, which is particularly advantageous during normal running when the main drive is used exclusively. The second clutch can also be constructed as itself an engaging and disengaging synchronous clutch which automatically connects the auxiliary drive to the propeller shaft when the speed of the auxiliary drive exceeds that of the propeller shaft.

In a preferred construction of the present invention, the first and second clutch can be selectively closed or opened in order to transmit a drive torque of the main drive or auxiliary drive to the propeller shaft of the ship. In a particularly preferred construction, both clutches can also be closed in such a way that drive torques of the main drive and of the auxiliary drive are transmitted to the propeller shaft.

The gear unit is received in a gear unit housing, while at least the first clutch or second clutch, preferably both clutches together, are received in a clutch housing that is structurally separate from the gear unit housing. As a result of this inventive arrangement of the gear unit and clutch(es) in separate housings, the function of the gear unit and the engaging and disengaging function or coupling function can be advantageously decoupled from one another and do not negatively influence one another.

According to one embodiment of the invention, the first clutch the second clutch and/or the auxiliary drive, preferably all three of these elements, are arranged on the side of the gear unit remote of a driven-side end of the propeller shaft provided for connecting to a propeller, i.e., on the forward side of the ship in the installed state. In a preferred construction, the two clutches are arranged between the gear unit and the auxiliary drive which is arranged in front of the latter on the forward side of the ship. In another preferred construction, the first clutch is adjacent to the gear unit and the second clutch is adjacent to the auxiliary drive.

By means of the arrangement of the first clutch, the second clutch and/or the auxiliary drive on the forward side of the ship, the force flow between the gear unit and therefore the main drive and propeller is advantageously shortened and the loading of the propeller shaft is accordingly reduced. Better use can be made of the existing installation space by relocating the clutches and the auxiliary drive to the forward side of the ship in front of the gear unit. In connection with the clutch housing which is separate from the gear unit housing, a flexibility in the design of the individual assemblies is advantageously provided and mutual influences are reduced at the same time.

In a preferred construction of the present invention, the gear unit has a hollow shaft driven by the main drive, for example, by means of one or more toothed stages and/or planetary stages, and through which the propeller shaft is guided. This provides a particularly compact construction which makes possible an aligned arrangement of the gear unit, or gear unit hollow shaft, propeller shaft, first clutch, second clutch, and/or auxiliary drive.

The first clutch is preferably be connected to the gear unit and/or to the propeller shaft by means of an angularly movable and/or axially movable clutch, for example, a diaphragm clutch or toothed clutch. This advantageously compensates for tolerances or foundation-related displacements of the gear unit or gear unit housing receiving the latter relative to the first clutch or clutch housing receiving the latter. In particular, in a construction of this kind the first clutch can be connected to the gear unit and/or to the propeller shaft by a torsional element, particularly a preferably hollow torsion shaft, in order to compensate for deformations of the ship or foundation, torsional vibrations in the gear unit or propeller shaft, and the like.

The propeller shaft is preferably constructed in one piece or is preferably composed of a plurality of shaft portions which are connected to one another. When the propeller shaft comprises a plurality of shaft portions which are connected to one another, for example, by means of flange connections, this facilitates manufacture and assembly of the individual assemblies.

In a preferred construction of the present invention, at least one of the first clutch and second clutch is mounted on a shaft of the gear unit or propeller shaft and and the second clutch is mounted on the propeller shaft or a driven shaft of the auxiliary drive. For example, the first clutch and/or second clutch mounted in at least one radial-axial bearing, preferably additionally in a radial bearing on the propeller shaft, the second clutch is mounted in at least one radial-axial bearing on a driven shaft of the auxiliary drive. Tensions due to different thermal expansion coefficients in the shafts and clutches can be reduced or prevented by mounting one or both clutches in bearings on one of the shafts of the torque transmission device.

The propeller shaft is preferably mounted radially and/or axially one or more times, for example, in the gear unit, in particular a gear unit hollow shaft, the gear unit housing and/or in the clutch housing. In addition or alternatively, the propeller shaft can also be mounted in a separate housing to reduce the mutual influence of the bearing supports, gear unit or clutch, e.g., by vibrations, wear, or the like.

A torque transmission device according to one of the embodiment of the invention can advantageously have a short construction. The maximum distance between the gear unit housing and the clutch housing is preferably be at most eight-times and preferably less than seven-times the minimum diameter of the propeller shaft.

In a preferred construction of the present invention, the gear unit housing and the clutch housing are connected to one another flexibly, particularly in an oil-tight manner. The flexible connection minimizes mutual influence of the housing on the gear unit or clutch, while a common lubricating system can advantageously be used at the same time.

The main drive preferably comprises one or more gas turbines and/or diesel motors which present a particularly economical marine propulsion unit in normal running. The auxiliary drive can comprise one or more electric motors which permit a smooth creep running in particular. High torque loads can occur particularly when the main drive and auxiliary drive are both connected to the propeller shaft in order to apply maximum drive torque. Therefore, in a preferred construction, the torque transmission device is constructed for large propeller torques, particularly of at least 250 kNm, preferably at least 300 kNm.

BRIEF DESCRIPTION OF THE DRAWINGS

Further advantages and features follow from the embodiment example which is shown in a partially schematic manner.

DETAILED DESCRIPTION OF THE PRESENTLY PREFERRED EMBODIMENTS

Figure 1:
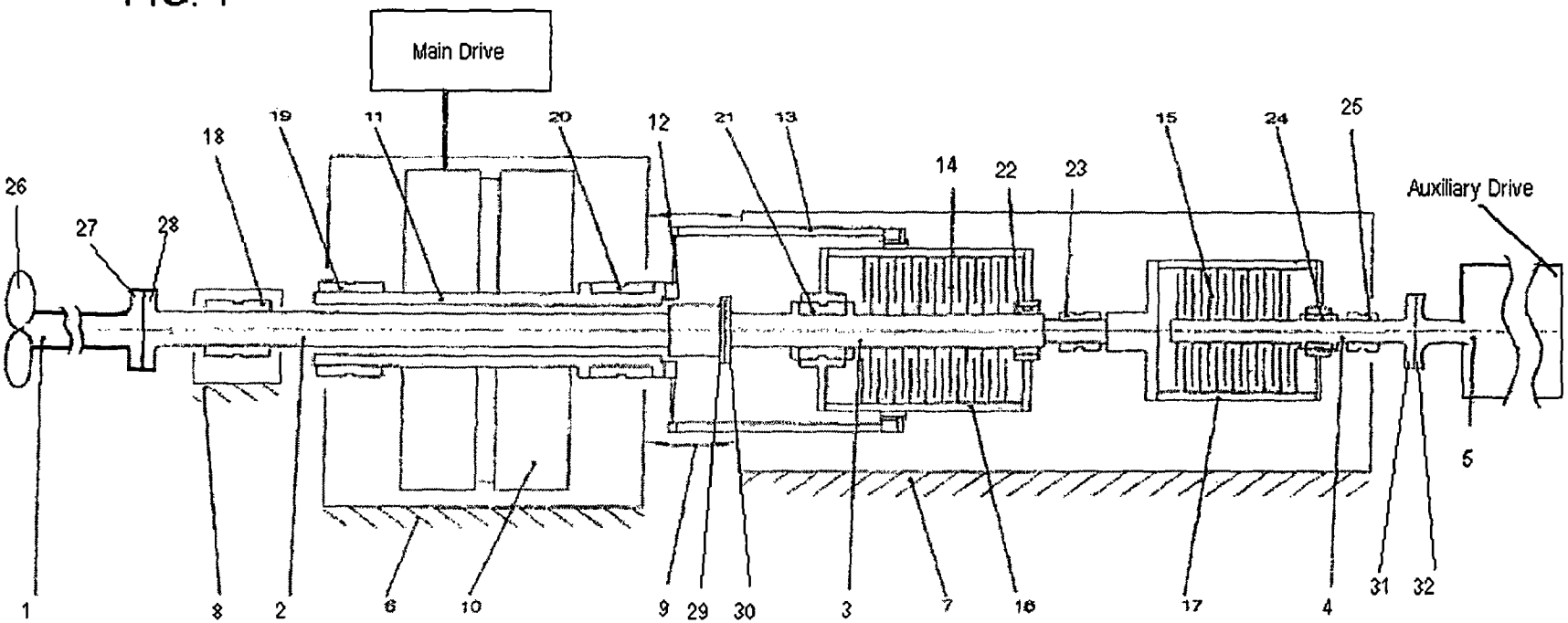
FIG. 1 shows a marine propulsion unit with a torque transmission device according to one construction of the present invention.

The marine propulsion unit which is shown in parts in FIG. 1 comprises a torque transmission device according to one embodiment of the present invention.

A propeller shaft comprises a plurality of shaft portions 1, 2 and 3 which are connected to one another by flanges 27, 28, 29, 30 and has a propeller 26 at the end on the rear side of the ship.

A main drive, which is constructed as a gas turbine shown schematically, can drive a gear unit hollow shaft 11 by means of a gear unit tooth stage 10 as it is known by those skilled in the art. Gear unit hollow shaft 11 is connected to the gear unit tooth stage 10 to be fixed with respect to rotation relative to it. The turbine speed is geared to a desired propeller speed by toothed gear stages and/or planetary gear stages not shown in detail. The gear unit hollow shaft 11 is rotatably mounted in a gear unit housing 6 in two bearings 19, 20 on both sides of the gear unit tooth stage 10. The gear unit housing 6 is in turn fixedly connected, e.g., by screwing, welding, or the like to a foundation of the ship. For this purpose, the bearing 20 on the forward side of the ship (at right in FIG. 1) is preferably constructed as a radial-axial bearing, and the bearing 19 on the rear side of the ship is preferably constructed as a radial bearing.

The gear unit hollow shaft 11 is fastened to a hollow torsion shaft 13 by an angularly movable and axially movable diaphragm clutch 12 so as to be axially and angularly compensating. The torsion shaft 13 is connected in turn to an outer disk support 16 of a first engaging and disengaging separating clutch 14 so as to be fixed with respect to rotation relative to it. The outer disk support 16 is supported on the clutch portion 3 of the propeller shaft in a radial-axial bearing 21 facing the gear unit and in a radial bearing 22 remote of the gear unit and is received in a clutch housing 7.

When the first clutch 14 is closed, inner disks which are connected to the clutch portion 3 of the propeller shaft so as to be fixed with respect to rotation relative to it cooperate in a frictionally locking manner with the outer disks which are arranged in the outer disk support 16 so as to be fixed with respect to rotation relative to it and transmit a drive torque of the gas turbine via the gear unit to the gear unit portion 2 of the propeller shaft guided that is guided through the gear unit hollow shaft 11. Deformations and tolerances of the ship foundation can be compensated for in an advantageous manner by the stationary-movable bearing 21, 22, the angularly movable and axially movable diaphragm clutch 12 and the elastically deformable hollow torsion shaft 13.

The gear unit portion 2 of the propeller shaft that is connected to the clutch portion 3 by a flange connection 29, 30 and is supported in a radial bearing 23 received in the clutch housing 7 and a bearing 18 which is received in a separate housing 8 connected to the ship's foundation.

A driven shaft 4, 5 of an auxiliary drive formed in one embodiment as an electric motor carries at its end facing the propeller 26 a set of inner disks and is supported in a bearing 25 in the clutch housing 7, this driven shaft 4, 5 comprises multiple parts and is joined by flange connections 31, 32. A set of outer disks cooperating with the inner disks is arranged in an outer disk support 17 of a second clutch 15 so as to be fixed with respect to rotation relative to it, this second clutch 15 being supported on the forward side of the ship in a radial-axial bearing 24 and connected on the rear side of the ship to the clutch portion 3 of the propeller shaft supported in the radial bearing 23 so as to be fixed with respect to rotation relative to the clutch portion 3.

When this second clutch 15 which is likewise received in the clutch housing 7 is closed, the inner and outer disks transmit the drive torque of the electric motor to the propeller shaft by frictional engagement. When the first clutch 14 is opened at the same time, the propeller is only driven by the electric motor without the gear unit rotating along with it, which is advantageous particularly for silent running. When, conversely, only the first clutch 14 is closed, while the second clutch 15 is open, the gas turbine acts only on the propeller 26 without lossy rotation of the electric motor. However, when both clutches 14, 15 are closed, the gas turbine and electric motor both impress a drive torque on the propeller shaft portions 1, 2, 3 and accordingly provide maximum driving force. Finally, if both clutches 14, 15 are open, the propeller shaft can rotate without losses.

A negative influence of thermal expansion on the two clutches 14, 15 is advantageously reduced by the radial-axial bearing 21, 24 of the clutches 14, 15 on the propeller shaft and driven shaft. This is because the clutches 14, 15 are displaced in axial direction by the two bearings 21, 24 in case of thermal expansion. The offset occurring in this case is compensated by the axially compensating and angularly compensating diaphragm clutch 12.

The two housings 6, 7 are connected to one another by a flexible, oil-tight connection 9 so that the clutches 14, 15 and the gear unit can use a common oil supply.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

REFERENCE NUMBERS

1 shaft portion of the propeller shaft
2 gear unit portion of the propeller shaft
3 clutch portion of the propeller shaft
4 shaft portion of a driven shaft of an electric motor
5 shaft portion of a driven shaft of an electric motor
6 gear unit housing
7 clutch housing
8 bearing housing
9 flexible oil-tight connection
10 gear unit tooth stage
11 gear unit hollow shaft
12 angularly movable and axially movable diaphragm clutch
13 hollow torsion shaft
14 first clutch
15 second clutch
16 outer disk support of the first clutch
17 outer disk support of the second clutch
18 radial bearing
19 radial bearing
20 radial-axial bearing
21 radial-axial bearing
22 radial bearing
23 radial bearing
24 radial-axial bearing
25 radial bearing

What is claimed is:

1. A torque transmission device for a ship configured to transmit a drive torque from at least one of a main drive and an auxiliary drive to a propeller shaft of the ship, the transmission device comprising:

a first clutch mounted on one of a gear unit shaft and the propeller shaft;

a second clutch mounted on one of the propeller shaft and a driven shaft of the auxiliary drive;

a gear unit configured to be driven by the at least one of the main drive and the auxiliary drive and configured to be connected to the propeller shaft by at least one of the first clutch and the second clutch;

a gear unit housing configured to house the gear unit; and a clutch housing configured to house at least one of the first clutch and the second clutch, the clutch housing being separate from the gear unit housing, wherein the first clutch, the second clutch, and the auxiliary drive are arranged on a side of the gear unit opposite a propeller and at least one of the first clutch and second clutch is mounted in a bearing on a shaft of the torque transmission device.

2. The torque transmission device according to claim 1, wherein the gear unit comprises a hollow shaft configured to be driven by the main drive and through which the propeller shaft is guided.

3. The torque transmission device according to claim 1, wherein the first clutch is coupled to at least one of the gear unit and the propeller shaft by an angularly movable clutch.

4. The torque transmission device according to claim 3, wherein the clutch is at least one of a diaphragm clutch and a toothed clutch.

5. The torque transmission device according to claim 1, wherein the first clutch is coupled to at least one of the gear unit and the propeller shaft by a torsional element.

6. The torque transmission device according to claim 5, wherein the torsional element is a torsion shaft.

7. The torque transmission device according to claim 1, wherein the propeller shaft comprises a plurality of shaft portions which are connected to one another by flange connections.

8. The torque transmission device according to claim 1, wherein the propeller shaft is mounted in one of the gear unit housing, the clutch housing, and a separate housing.

9. The torque transmission device according to claim 1, wherein a maximum distance between the gear unit housing and the clutch housing is eight times a minimum diameter of the propeller shaft.

10. The torque transmission device according to claim 9, wherein the maximum distance between the gear unit housing and the clutch housing is seven times the minimum diameter of the propeller shaft.

11. The torque transmission device according to claim 1, wherein at least one of the first clutch and the second clutch is a multi-disk clutch.

12. The torque transmission device according to claim 1, wherein the gear unit housing and the clutch housing are connected to one another in an oil-tight manner.

13. The torque transmission device according to claim 1, wherein the main drive comprises at least one of a gas turbine and a diesel motor.

14. The torque transmission device according to claim 1, wherein the auxiliary drive comprises at least one electric motor.

15. The torque transmission device according to claim 1, wherein the first clutch is coupled to at least one of the gear unit and the propeller shaft by an axially movable clutch.

16. The torque transmission device according to claim 1, wherein the gear unit shaft is a gear unit hollow shaft.

17. The torque transmission device according to claim 1, wherein the bearing is at least one of a radial-axial bearing and a radial bearing.

18. A marine propulsion unit comprising:

a main drive for driving a propeller shaft of a ship;

an auxiliary drive for driving the propeller shaft of the ship;

a first clutch mounted on one of a gear unit shaft and the propeller shaft;

a second clutch mounted on one of the propeller shaft and a driven shaft of the marine propulsion unit;

a gear unit configured to be driven by the main drive that is configured to be connected to the propeller shaft by the first clutch, the gear unit further configured to be driven by the auxiliary drive that is configured to be connected to the propeller shaft by the second clutch;

a gear unit housing configured to house the gear unit; and a clutch housing configured to house the first clutch and the second clutch, the clutch housing being separate from the gear unit housing, wherein the first clutch, the second clutch, and the auxiliary drive are arranged on a side of the gear unit remote from a propeller and at least one of the first clutch and second clutch is mounted in a bearing on a shaft of the torque transmission device.

19. A torque transmission device for a ship configured to transmit a drive torque from at least one of a main drive and an auxiliary drive to a propeller shaft of the ship, the transmission device comprising:

a first clutch;

a second clutch;

a gear unit configured to be driven by the at least one of the main drive and the auxiliary drive and configured to be connected to the propeller shaft by at least one of the first clutch and the second clutch;

a gear unit housing configured to house the gear unit; and a clutch housing configured to house at least one of the first clutch and the second clutch, the clutch housing being separate from the gear unit housing, wherein at least one of the first clutch, the second clutch, and the auxiliary drive are arranged on a side of the gear unit opposite a propeller, wherein the first clutch is mounted on one of a gear unit shaft and the propeller shaft; and the second clutch is mounted on one of the propeller shaft and a driven shaft of the auxiliary drive, and wherein at least one of the first clutch and second clutch is mounted in a bearing on a shaft of the torque transmission device.

20. The torque transmission device according to claim 19, wherein the bearing is at least one of a radial-axial bearing and a radial bearing.

* * * * *